United States Patent [19]

Johnson et al.

[11] Patent Number: 4,666,034

[45] Date of Patent: May 19, 1987

[54] FOUR ROUND PROJECTILE CONTAINER AND LATCHING MECHANISM

[76] Inventors: Bruce S. Johnson; Timothy F. Elliott, both of P.O. Box 1512, York, Pa. 17405

[21] Appl. No.: 816,271

[22] Filed: Jan. 6, 1986

[51] Int. Cl.[4] ..... F42B 37/00; B65D 81/02; B65D 85/20

[52] U.S. Cl. ..... 206/3; 206/443; 206/521; 206/585; 206/589; 206/804; 220/4 F; 220/23.4; 220/23.6; 294/68.1

[58] Field of Search ..... 206/3, 443, 446, 521, 206/585, 588, 589, 804, 513, 397, 405, 408, 493; 220/4 F, 4 C, 4 D, 23.4, 23.6; 294/26, 67.1, 19.1, 68.1, 87.1; 89/40.07, 40.12, 40.14

[56] References Cited

U.S. PATENT DOCUMENTS

| | | | |
|---|---|---|---|
| 193,479 | 7/1877 | Burgin | 220/23.4 |
| 1,137,583 | 4/1915 | Cox | 215/100 |
| 2,457,262 | 12/1948 | Norquist | 206/3 |
| 2,472,939 | 6/1949 | Connolly | 294/68.1 |
| 2,774,474 | 12/1956 | Phillips | 206/3 |
| 3,484,014 | 12/1969 | Munch | 294/68.1 |
| 3,524,540 | 8/1970 | Brown et al. | 206/444 |
| 4,205,749 | 6/1980 | Carroll et al. | 220/23.4 |
| 4,236,441 | 12/1980 | Turner et al. | 89/40.07 |
| 4,538,724 | 9/1985 | Johnson | 206/3 |
| 4,566,588 | 1/1986 | Kataczynski | 206/585 |

*Primary Examiner*—Joseph Man-Fu Moy
*Assistant Examiner*—Brenda J. Ehrhardt
*Attorney, Agent, or Firm*—Kerkam, Stowell, Kondracki & Clarke

[57] ABSTRACT

A transport and storage container for artillery shells and other projectiles has a base member and cover each of molded plastic rectangular box-like form defining four (4) projectile compartments. The base member has supporting hardware including a vertical central tube, hoop frames around the exterior of the base member and transverse connecting rods between the central tube and the hoop frames. Corner recesses in the base member provide access to the respective corner portions of the hoop frames allowing the corner portions to be used as attachment and lifting points so that containers can be coupled together in groups. The cover is attached to the base member via a central latch rod which threads into the central base member tube. A projectile self-latching mechanism is provided in each projectile compartment of the base member.

29 Claims, 16 Drawing Figures

FOUR ROUND PROJECTILE CONTAINER AND LATCHING MECHANISM

FIELD OF THE INVENTION

This invention relates to containers for carrying and/or storing projectiles, and to a projectile self-latching mechanism which may be used in combination with such containers. For simplicity of description, the term "projectiles" as used herein shall be considered to include shells, missiles, torpedoes, bombs, and more general ammunition.

BACKGROUND OF THE INVENTION

The present invention relates to magazines for carrying and/or storing projectiles and in particular to a battlefield magazine having an external reinforcing frame.

Modern war is often a war of logistics where the winner is determined by the ability to efficiently transport men and material. Accordingly, it is essential to optimize the conveyance of ammunition such as projectiles and shells.

The storage or transportation of projectiles generally requires a balancing between two conflicting considerations. On the one hand, the projectiles should be stored such that it is easy to remove them from their storage mechanism as required for usage of the projectiles. On the other hand, the projectiles must be stored such that they are secure in their storage arrangement and will not be jarred loose by nearby explosions or while being transported along a bumpy road. Generally, the more secure a projectile is from accidental dislodgement, the more time-consuming it is to remove the projectile from its storage facility.

Other factors to be considered in the storage or transportation of projectiles is the need to not only protect the projectiles from damage but to provide devices to aid in the compact storage of the projectiles. In addition, there is a need to provide for easy lifting and conveying of one or a number of projectiles in a protective enclosure.

One common method for transportation and storage of projectiles is by use of a wooden pallet. The pallet is normally configured in two rows of four projectiles. The wooden pallet consists of uppr and lower wood laminates held together with steel banding. The bases of the projectiles rest on the lower wood laminate board and the nose protrudes through holes drilled in the top wood laminate board.

The use of wooden pallets is subject to numerous disadvantages. For one thing, the steel banding must be cut or otherwise removed to allow access to all of the projectiles, this in turn necessitating the rebanding of the wooden pallet if the projectiles are to be resecured. Further, the pallet does not protect the projectiles from incidental mechanical damage or from a contaminated environment (storage under high humidity or other harsh conditions or nuclear, biological, or chemical agents). Accordingly, the projectiles require periodic maintenance at considerable expense or likewise expensive decontamination where enemy action has resulted in nuclear, biological, or chemical agents contaminating the outside of the projectiles. In order to maintain or decontaminate the projectiles, the pallet must be broken apart. The projectiles must then be treated to protect them from environmental deterioration and/or to decontaminate them. The projectiles must then be replaced upon the pallet and the upper and lower boards of the pallet must be rebanded together.

A further disadvantage of the wooden pallet method is that the projectiles must be removed from the pallets in order to allow them to be readied for usage by placement within an ammunition resupply vehicle such as that disclosed in the U.S. Pat. No. 4,236,441 entitled "Field Artillary Ammunition Support Vehicle" issued on Dec. 2, 1980 to John Turner, Richard A. Koster, and Seymour Bassman, and assigned to the assignee of the present application. Some of the prior art problems with storage and transportation of projectiles have been overcome by the Battlefield Magazine disclosed in U.S. Pat. No. 4,538,723 to Johnson and Borst, issued Sept. 3, 1985 and by the Projectile Lock Assembly disclosed in U.S. Pat. No. 4,344,528, issued Aug. 17, 1982 to Ayyala Perisastry, Richard A. Vishe, and Peter J. Hoet. The projectile lock assembly disclosed in that patent, which is assigned to the assignee of the present invention, uses a track having a plurality of parallel cylindrical tubes. A number of locking assemblies are mounted along each of the tubes and used for individually locking projectiles within the associate tube. The battlefield magazine and projectile lock assembly of the Johnson et al and the Perisastry et al patents aforementioned are extremely useful in providing a storage rack for projectiles. The structures are somewhat complex, but they are most practical under conditions where projectiles must be separately removed from a storage rack. That is, they are advantageous in an ammunition resupply vehicle of the type shown in U.S. Pat. No. 4,236,441 where projectiles must be normally secured during the vehicle's movement and selectively removed from projectile storage zones as necessary for conveyance to a self-propelled howitzer or other weapon. However, the expense and complexities of the locking structure generally would preclude its use for transportation of projectiles except where individual projectile access is required (i.e., at or near the battlefront where projectiles are fused and/or loaded into weapons).

As will be readily appreciated, the transfer of projectiles from a wooden pallet to the projectile rack and lock assembly adds a time consuming step to the overall process of most efficiently getting projectiles from the factories/and or long term depots to the racks from which the projectiles may be stored and conveyed under battlefield conditions.

SUMMARY OF THE INVENTION

It is an object of the invention to provide a new and improved container for projectiles.

Another object of the invention is to provide a modular form of projectile container which can be used singly as a module for storing and/or transporting a plurality of projectiles, and which can readily be coupled to one or more like container modules both vertically and horizontally to form a container group which may be stored and/or transported as a unit.

Still another object of the invention is to provide an integrated projectile storage and/or transportation system including modular projectile containers as aforesaid, coupling hardware for interconnecting individual containers into a group, and a transport means specifically adapted to accommodate a container.

Still another object of the invention is to provide a projectile container comprising a base portion and a cover which can be attached together for transport, which can be stacked and/or coupled with other like containers either vertically or horizontally, and which, when oriented horizontally can have the cover removed so that the base portion serves as a storage/dispensing rack.

Yet another object of the invention is to provide an automatic projectile self-latching mechanism which may be used with a container as aforesaid to automatically latch and securely retain a projectile in a container compartment responsive to insertion of the projectile therein.

Broadly stated, the invention provides a modular container for transporting and storing a plurality of artillery or like projectiles, preferably up to four (4) in number, the container comprising a molded plastic base of rectangular box like form provided with individual projectile compartments, a cover, releasable attachment means between the base and cover and metal supporting hardware for the base. The supporting hardware may, for example, comprise a pair of hoop frames which surround the base adjacent the top and bottom thereof respectively, the hoop frames being connected by transverse metal rods to a central support tube which extends vertically through the base from a support disc under a bottom wall of the base. The base may be provided with corner recesses which provide access to corner portions of the respective hoop frames so that the corner portions of the frames may be used as lifting or attachment points for the container. The height of the respective compartments in the base may be such as to receive the projectiles with about one-half the length of each projectile protruding from the respective compartment.

The cover may comprise a plastic molding of similar box like form to the base, with complementary projectile compartments and may have a centrally disposed rotary latch rod for threading into the top of the central base tube for attaching the cover to the base. The top of a latch rod may be formed with a lifting eye so that when the container is lifted thereby the load is transferred down through the latch rod and tube to the support disc on the bottom of the container.

Another feature of the invention resides in an automatic self-latching mechanism which may be used in each of the projectile compartments of the base for releasably retaining the respective projectiles therein. The latching mechanism may, for example, be mounted in the wall of each projectile compartment for automatically locking the respective projectile in place when it is inserted into the compartment and for positively retaining the projectile therein until an upper end portion of the latching mechanism is pulled upwardly to release the projectile.

Other features of the invention reside in the provision of suitable clips, lifting devices and the like for connecting individual containers together both horizontally and vertically to form a unitary container group, and to a specific form of hand-cart device for transporting containers.

Additional features and advantages of the invention will become apparent by reference to the ensuing description and claims read in conjunction with the attached drawings.

DESCRIPTION OF PREFERRED EMBODIMENTS

Figure 1:
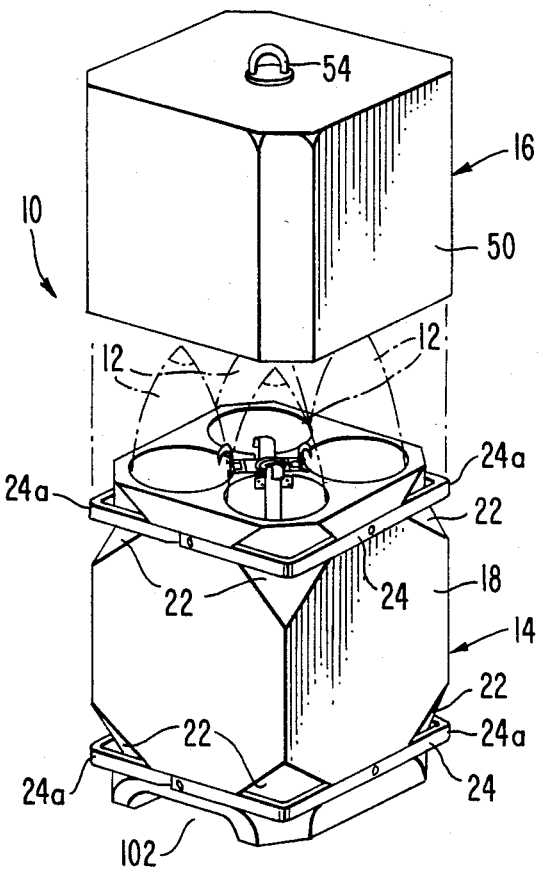
FIG. 1 is an exploded perspective view of a projectile container base portion and cover in accordance with the invention.
Figure 2:
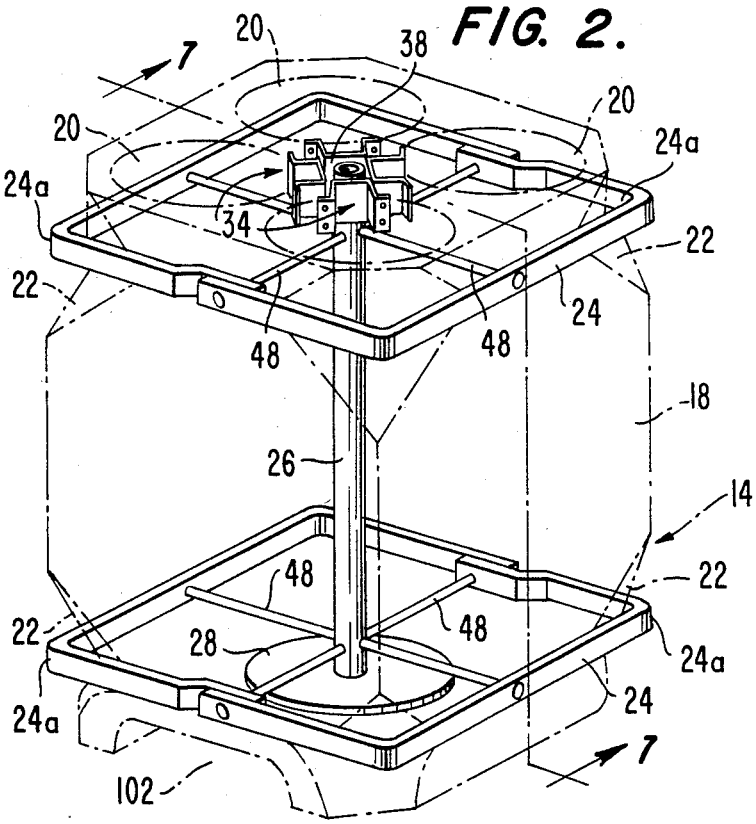
FIG. 2 is enlarged perspective view of the base portion shown partly in phantom.
Figure 3:
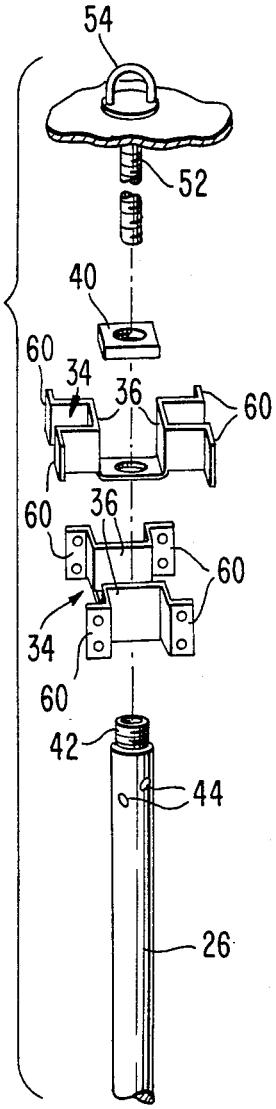
FIG. 3 is a further enlarged exploded perspective view of parts of a support frame and associated hardware for the container.

A storage container 10 for up to four (4) artillery shells 12, or other projectiles, comprises generally a rectangular box-like base portion 14 and a conforming cover 16. Both the base portion and the cover may be rotationally molded in high-density polyethylene, and provided with metal supporting hardware, to be described. When the cover is attached to the base portion, the projectiles are completely enclosed and protected.

The base portion molding 14 may, for example, include an outer shell part 18 and an inner shell part providing four (4) symmetrically disposed cylindrical projectile compartments 20. Outer shell part 18 is molded with upper and lower corner recesses 22 to be aligned, in assembly, with upper and lower two-part hoop frames 24 which are part of the supporting hardware, such hardware being attached to the base portion 14 after molding. The hardware further includes a central tube 26 having a support disc 28 welded to its lower end. Tube 26 is inserted upwardly through centrally located openings 30, 32 in the base between the respective projectile compartments, the upper end portion of the tube being passed through a pair of crossed latch brackets 34 fitting in recesses at the top of the base. The latch brackets have inner vertical walls 36 together defining a square central pocket 38 through which tube 26 passes. A square nut 40 is held captive in the pocket and is threaded onto a top threaded section 42 of tube 26 to retain the tube in position. Tube 26 is further formed with upper and lower sets of through holes 44 adapted to align with hoop frames 24, and with aligned holes 46 in shell part 18 when the tube is suitably tightened onto nut 40. Radial retaining rods 48 are passed through the aligning holes 44, 46 and have their outer ends welded to the hoop frames. Thus, an integrated metal supporting structure is provided for base portion 14 comprising the interconnected tube 26, retaining rods 48, and hoop frames 24. It will be noted that the provision of recesses 22 provides access to the corner portions 24a of the hoop frames whereby the hoop frame corner portions serve as lifting and/or attachment points for the container, as will be described.

Cover 16 may be molded in similar manner to base portion 14, as a one-piece molding, with an outer shell part 50 and inner projectile compartments, not shown, complementary to the compartments in the base. A central threaded latch rod 52 with a lifting eye 54 at the top is rotatably mounted in top wall 56 of the cover and extends down through the cover so that its lower end can be threaded into tube 26 (which is internally threaded for this purpose) for releasably securing the cover the base portion. The heights of the respective compartments may be such that about half the height of each projectile protrudes from the base for receipt in one of the cover compartments.

Figure 4:
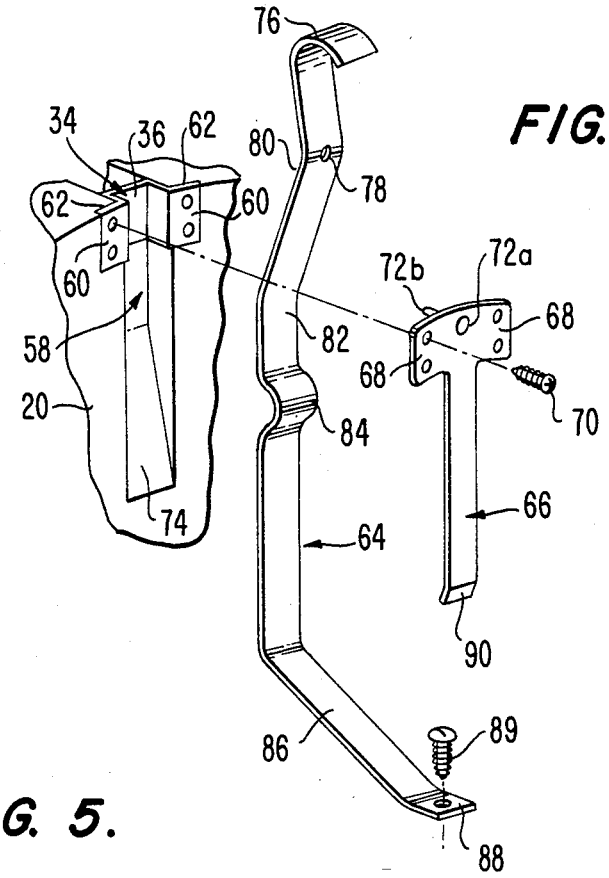
FIG. 4 is an exploded perspective view of a projectile latching mechanism used in the container.
Figure 5:
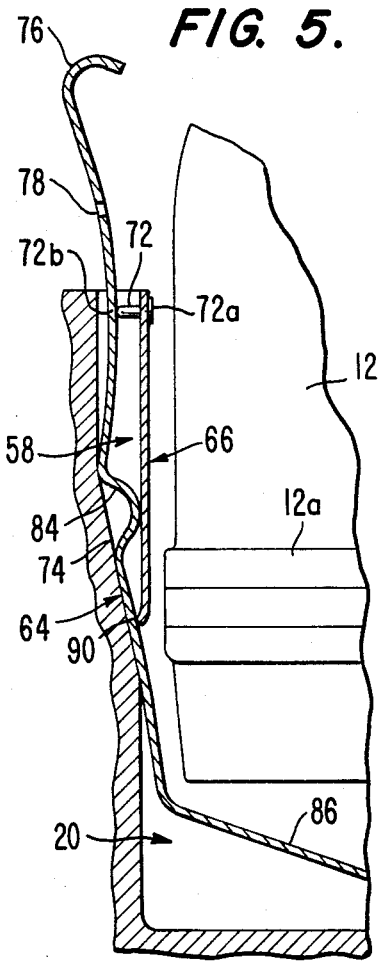
FIG. 5 is a sectional elevational view of a part of the container base portion showing the latching mechanism in unlatched condition.
Figure 6:
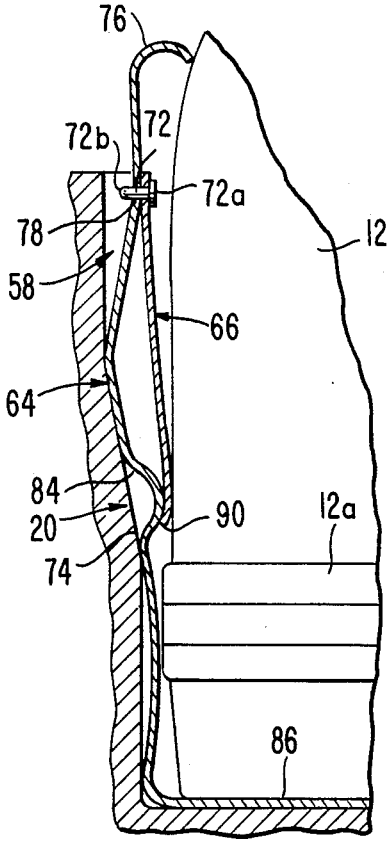
FIG. 6 is a view similar to FIG. 5 showing the latching mechanism in latched condition.
Figure 7:
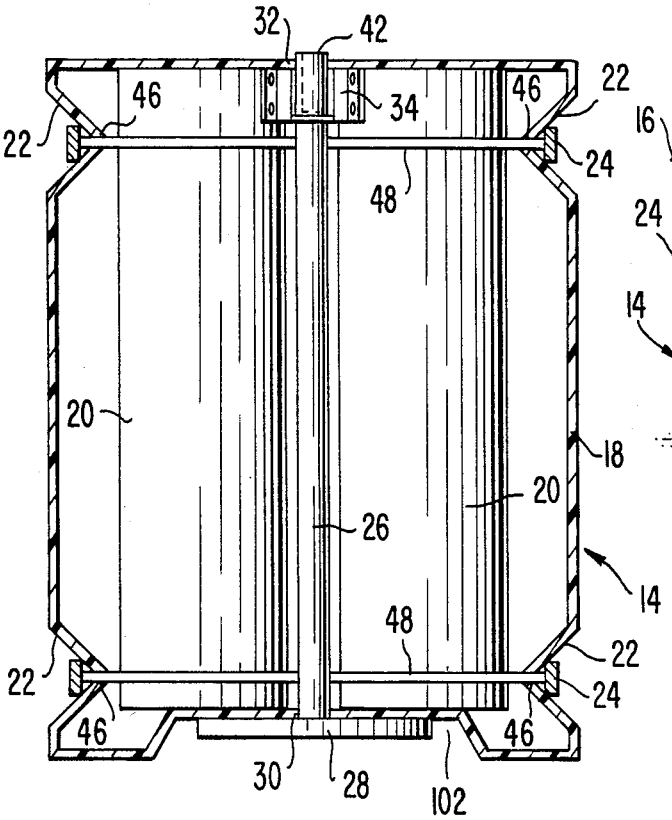
FIG. 7 is a sectional view on line 7—7 of FIG. 2.
Figure 8:
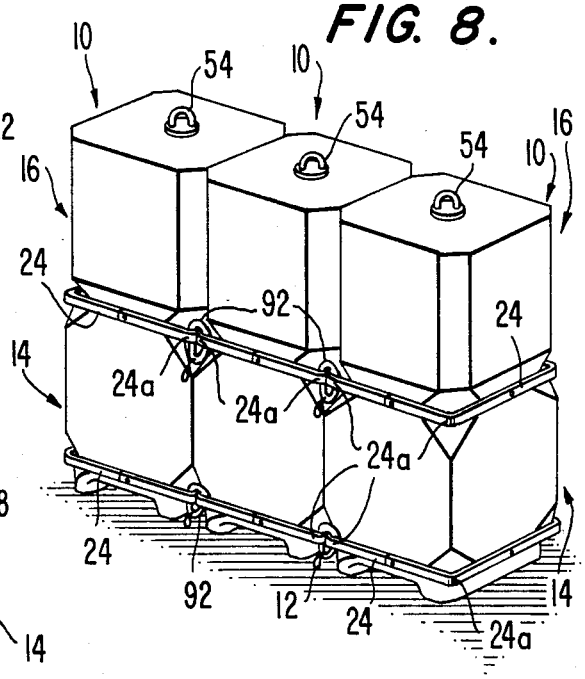
FIG. 8 is a perspective view of three containers connected together as a unit.

The latch brackets 34 fit at the top of elongate recesses 58 formed in the peripheral walls of the respective projectile compartments, each latch bracket providing flanges 60 which fit in wall rebates 62 at the tops of the respective recesses 58, and which form mounting means for respective projectile self-latching mechanisms, as shown more particularly in FIGS. 4–6. Each latching mechanism includes an elongate lever 64 which fits in the respective recess 58, and a T-shaped latch member 66 with flanges 68 that attach to the flanges 60 of the respective brackets 34 via screws 70. Latch member 66 is further provided with a central latch pin 72. The lever 64 and latch member 66 are formed or stamped from spring steel, and latch pin 72 is a hardened steel pin with a head 72*a* and a rounded nose 72*b*, the pin being permanently pressed into latch member 66. Recesses 58 are formed with elongate ramp surfaces 74 at their lower ends.

Each lever 64 is an elongated strip of spring steel having its upper end curved to form a hook 76 which allows the lever to be pulled upwards and outwards with respect to the projectile compartment. Part way down the lever is a hole 78 for engaging latch pin 72, and bends 80, 82 which provide an offset for keeping the lever pressed against the latch pin. Further down its length, the lever is formed with an inwardly directed projection 84 which acts as a rubbing block for pushing latch 66 against the respective projectile 12. At its lower end, lever 64 has a bent actuating portion 86 inclined downwardly and extending transversely across the projectile compartment. Portion 86 of the lever terminates in a tip 88 which is attached by a single screw 89 to the base of the respective projectile compartment. The bottom portion 90 of latch member 66 is bent slightly outwardly to prevent it from catching on sealing band 12a of the respective projectile when it is being removed.

In the released position of the latching mechanism FIG. (5) lever 64 is urged upwardly by the spring action of its lower end portion 86, and latch pin 72 holds the lever against the outer wall of recess 58. Projection 84 is at the top of ramp surface 74 allowing latch member 66 to lie substantially flush with the surface of the respective projectile compartment 20. The two (2) bends 80, 82 in the lever cause it to press tightly against the latch pin. As a projectile 12 is lowered into the compartment, it contacts portion 86 of the lever and pulls the lever down in recess 58. As the lever moves down, projection 84 slides down ramp surface 74 and presses the lower end of latch 66 against the projectile above sealing band 12*a*, the ramp surface providing a mechanical advantage causing the latch to press against the projectile with considerable force. When the projectile is fully bottomed FIG. (6) latch pin 72 snaps into hole 78 in the lever, thereby locking the mechanism, so that the latch forms a stop for sealing band 12a preventing the projectile from being withdrawn from the compartment, with the spring tension of the two offset bends 80, 82 in the lever keeping the lever pressed tightly over the latch pin.

To release the projectile, the hook 76 of the lever is pulled outwardly, to disengage the lever from latch pin 72, and upwardly. As the lever is pulled upwards, projection 84 moves up ramp surface 74 allowing the latch to move back to provide clearance for sealing band 12*a*, while the lower end portion 86 of the lever begins to lift the projectile, so that it can be removed from the compartment. The latching mechanism is thus restored to the unlocked position shown in FIG. 5 for receipt of a further projectile when it will again latch the projectile automatically as described. Attachment of the respective latching mechanisms to the flanges 60 of latch brackets 34 effectively transmits the loads imposed on the latch mechanisms directly to the central tube 26 and support disc 28.

Figure 9:
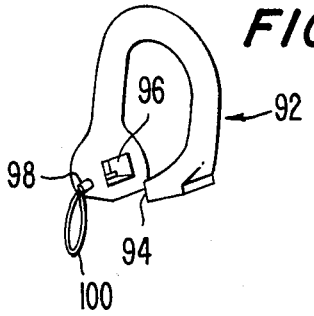
FIG. 9 is a perspective view of a clip used for connecting the containers.
Figure 10:
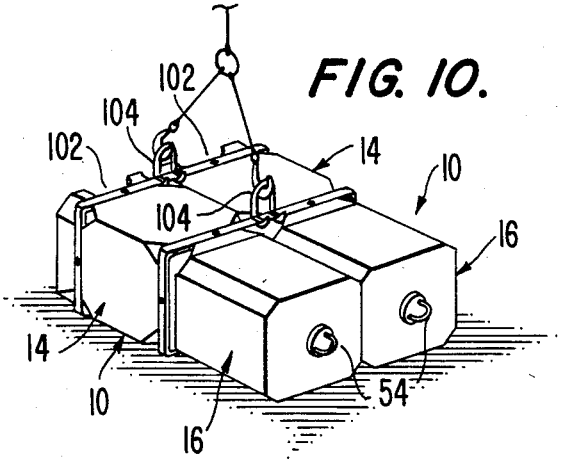
FIG. 10 is a perspective view of a pair of containers connected together for lifting by a crane.
Figure 11:
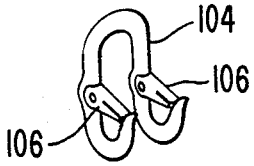
FIG. 11 is a perspective view of a lifting clip used for connecting the containers.
Figure 13:
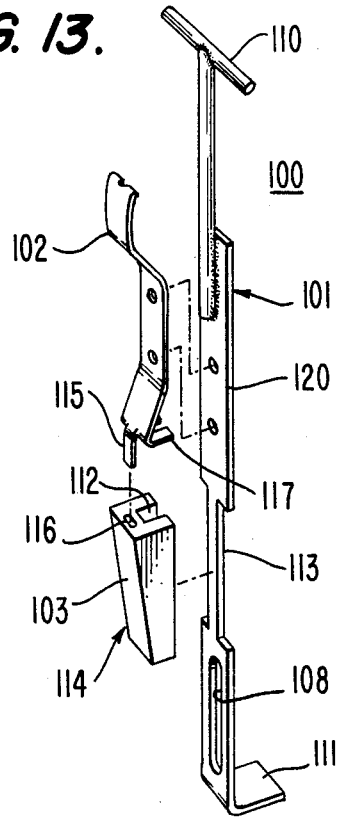
FIG. 13 is an exploded perspective view of the alternate embodiment of a projectile latching mechanism used in the container.
Figure 14:
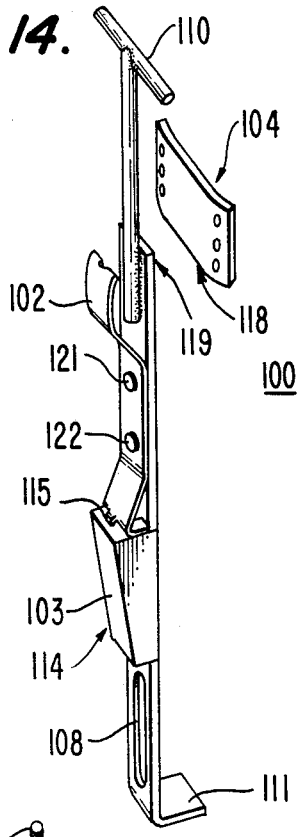
FIG. 14 is a perspective view of the latching mechanism shown in FIG. 13 with parts assembled.
Figure 15:
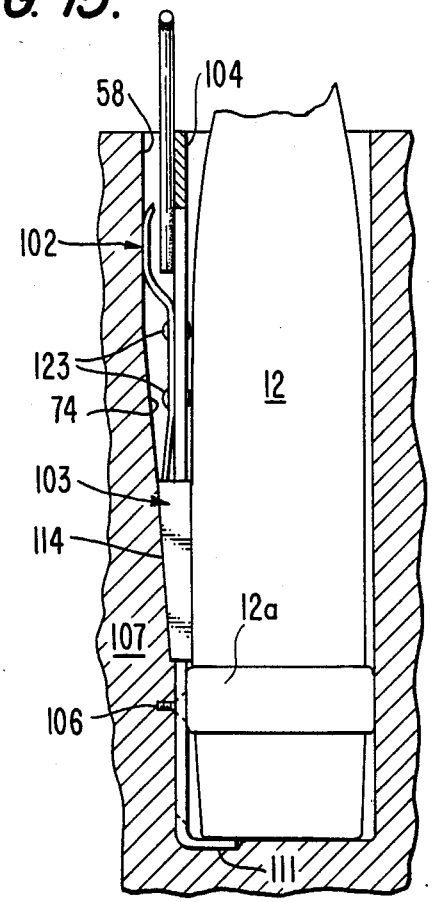
FIG. 15 is a sectional elevational view of part of the container base portion showing the latching mechanism in latched condition.

The container 10 may be stacked either vertically or horizontally with other like containers. When stacked horizontally, such as in the interior of a resupply vehicle, the covers 16 of the respective containers may be removed, so that the containers may function as a storage-dispensing rack. For shipping and handling purposes, the containers may be coupled together in groups (FIG. 9) by means of chains, hooks or specially designed coupling clips 92 (FIG. 10) which clip around adjacent corner sections 24*a* of the hoop frames 24 of adjacent containers. Clips 92 may be formed of molded Nylon or the like, with barb-shaped nose portion 94 which clips into a recess 96 and is held therein by a catch pin 98. A loop 100 on the end of the catch pin allows it to be withdrawn to release the clip. An interconnected group of containers can be lifted by a forklift, for example, with the forklift tines inserted in forklift slots 102 in the base of the respective containers, or interconnected groups of containers can be lifted by crane using the cover latch eyes 54. Alternatively, groups of containers may be lifted horizontally by looping a chain through adjacent hoop frame corner portions or, as shown in FIGS. 10 and 11, by using a double hook 104 for this purpose. The double hook 104 may be formed from forged steel, for example, with pivoted safety catches 106.

Figure 12:
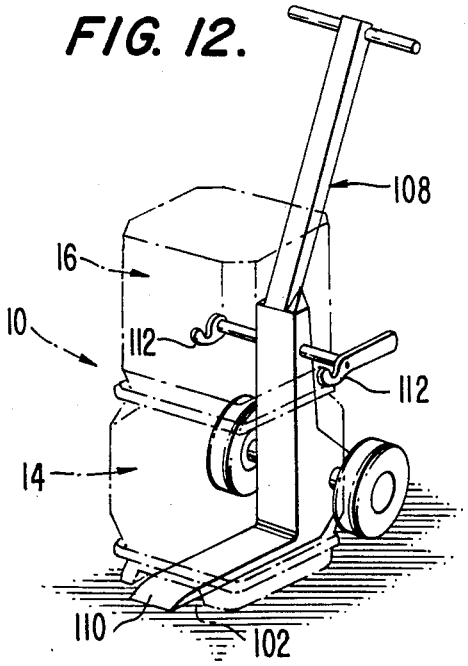
FIG. 12 is a perspective view of a container handcart.

FIG. 12 shows a foldable hand cart 108 for transporting the containers individually, the cart for example having a single foldable tine 110, and transversely disposed hook members 112 for engaging respective hoop frame corner sections of the container. The cart may be used, for example, for positioning containers in the bed of a supply truck and the like.

An alternate embodiment of another form of latch mechanism which may be mounted in the elongate recess 58 formed in the peripheral walls of the respective projectile compartments is illustrated in FIGS. 13–16. The self-latching mechanism 100 has only four major components: A latch assembly 101, a latch spring 102, a latch block 103 and a stop plate 104.

The latch handle assembly 101 is retained within the projectile opening 105 by a guide screw 106 which is secured to the container wall 107. An elongated slot 108 within the end of the latch handle limits the horizontal movement of the assembly. The stop plate 104 is secured to the outer portion of the projectile opening in a manner similar to flanges 60 of brackets 34 (FIG. 4) and serves to stop the latch handle assembly 101 in the latched position. A lever arm 111 formed on the inner end of the handle assembly 101 catches the end of the projectile and draws the mechanism into the latch position as the projective 112 is inserted into the container.

The latch block 103 is fabricated of hard plastic and includes a groove 112 which is retained on a tongue portion 113 of the latch handle assembly 101. The latch block 103 includes a wedge surface 114 which slides on a ramp 74 molded into the container wall 107. Latch spring 102 of spring steel is secured to the latch handle assembly 101 to provide an upward force on the latch block 103 against the container wall 107 and, simultaneously a downward force on the latch handle assembly 101 against the stop block 104. The opposite end of the latch spring 102 includes a central projection 115 that engages a blind orifice 116 molded in the latch block 103. Bifurcated portions 117 of the latch spring 102 are turned downward to reinforce the front surface of the latch block 103.

The stop plate 104 includes a beveled edge 118 which is engaged by a beveled edge 119 of the latch handle to form a positive stop from the downward pressure from the latch spring 102.

Figure 16:
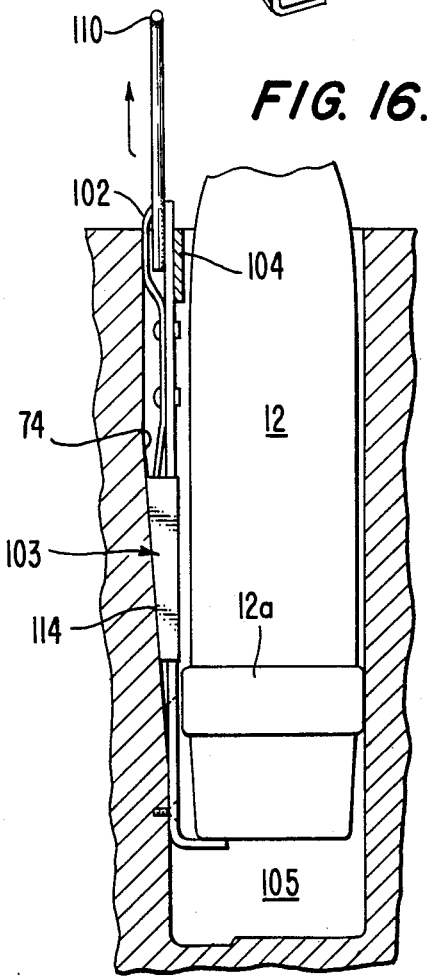
FIG. 16 is a view similar to FIG. 15 showing the latching mechanism in unlatched condition.

In the released or unlatched position as shown in FIG. 16, the latch handle assembly 101 is retained in an outward position, but held against the top of the projectile opening 105. As the projectile 12 is loaded into the container, the latch handle assembly 101 is moved inwardly by the lever arm 111. When the assembly is fully seated, the latch spring 102 will provide a downward force that will engage the mating beveled surfaces 118 and 119 of the stop plate 104 and the latch handle assembly 101, locking the mechanism into the latched position.

The projectile 12 is released by raising the latch handle 110 affixed to one end of a plate 120 by welding or the like to disengage the beveled surfaces 118 and 119 and pulling the latch handle outward. Plate 120 has provision therein for two holes 121 and 122 and spring 102 is provided with two like holes by which spring 102 is riveted to plate 120 by rivets 123. The latch block 103 is raised by the back half of the latch spring 102. The downward force against the projectile 12 is dissipated, and the projectile 12 is withdrawn an amount permitted by the length of the elongated slot 108, as the lever arm 111 engages the projectile 12 when the latch handle 110 is pulled.

While only preferred embodiments of the invention have been described herein in detail, the invention is not limited thereby and modifications can be made within the scope of the attached claims.

What is claimed is:

1. A container for projectiles comprising a molded plastic base member of rectangular box-like shape defining a plurality of substantially cylindrical top-opening projectile compartments, a cover for the base member, and metal reinforcing means for the base member including at least one hoop frame fitting around the exterior of the base member, the base member having corner recesses for providing access to corner portions of the hoop frame for use of said corner portions as lifting means for the container or as attachment means for connecting the container to another like container.

2. A container as defined in claim 1 wherein the hoop frame and recesses are located toward the top of the base member and are replicated toward the bottom of the base member.

3. A container as defined in claim 2 wherein the reinforcing means further includes a central reinforcing tube extending upwardly through the base member from a support disc under a base wall thereof and wherein the hoop frames are connected to the central tube by transverse reinforcing rods extending through the base member.

4. A container as defined in claim 3 wherein each reinforcing rod extends through a transverse opening in the central tube and has opposite ends attached to opposite sides respectively of one of the hoop frames.

5. A container as defined in claim 3 wherein the cover has a centrally located rotary threaded latch rod adapted to engage a complementary thread on an upper end portion of the central tube for attaching the cover to the base member.

6. A container as defined in claim 5 wherein the cover is of molded plastic rectangular box-like form having projectile compartments complementary to the compartments in the base member for receiving upper end portions of projectiles inserted in and protruding from the base member compartments.

7. A container as defined in claim 6 wherein the compartments are four (4) in number located symmetrically about the central tube and latch rod respectively.

8. A container as defined in claim 6 wherein the latch rod as a lifting eye atop an outer wall of the cover.

9. A container as defined in claim 1 which includes a projectile self-latching mechanism in each of said compartments of the base member for operation responsive to insertion of a projectile in the respective compartment to latch the projectile therein, the mechanism having manual release means operable for permitting withdrawal of the projectile from the compartment.

10. A container as defined in claim 9 wherein each self-latching mechanism comprises an elongate lever member extending down the peripheral wall of the respective compartment from an elongate recess in said wall at the top of the compartment, and a latch member having an upper end attached to said wall across the recess, the latch member extending downwardly over the lever member, the lever member having a transverse actuating portion at its lower end for engagement by a projectile when inserted in the compartment to press the lever member downwards in the compartment, the lever member further having a protrusion thereon for pushing the latch member transversely inwardly relative to the compartment when the lever member is pushed down by the projectile so that the latch member is moved to a blocking position in relation to a rotation band of the projectile, the latch member and lever member having respective latch formations mutually engaged when the lever is pressed down to a bottom wall of the compartment, and the lever member further having a manual gripping portion protruding from the compartment for releasing the latch formations and allowing the lever member to be raised to move the latch member to a non-blocking position whereby the projectile can be removed from the compartment.

11. A container as defined in claim 10 wherein the gripping portion of the lever member is formed as a hook.

12. A container as defined in claim 10 wherein said recess has an inclined ramp surface along which said protrusion on the lever member moves for shifting the latch member between the blocking and non-blocking positions.

13. The container as defined in claim 10 wherein the latch formations comprise a pin on said upper portion of the latch member and a hole in the lever member for receiving the pin.

14. A container as defined in claim 3 which includes a metal latch bracket for each projectile compartment, the respective latch brackets being carried on the upper end of the central tube and providing a mounting surface located on a peripheral wall of the respective compartment, and a projectile self-latching mechanism for each compartment for latching the projectile in the compartment responsive to insertion of the projectile therein, the mechanism having a latch member attached to said mounting surface whereby forces developed in the latching mechanism are transmitted through the latch bracket to the support tube.

15. A projectile container as defined in claim 14 wherein the compartments are four (4) in number disposed symmetrially about the central tube, the latch brackets comprising a pair of crossing members with flanges at their opposite ends defining the respective mounting surfaces, and central openings by which the members are received on the tube, the central portions of the respective members defining a pocket receiving a retention nut threaded onto the tube to retain same in assembled relation with respect to the container.

16. A projectile container comprising a molded plastic base member of rectangular box-like form defining a plurality of open-top projectile compartments, a molded plastic cover of conforming rectangular box-like form defining open-bottom projectile compartments complementary to the compartments in the base member, metal reinforcing means for the base member including a central tube extending upwardly through the base member from a support disc under a bottom wall of the base member, at least one hoop frame surrounding the base member, and transverse tie rod means extending through the base member between said compartments connecting the hoop frame to the central tube, and a central rotary latch rod extending downwardly through the cover from a top wall thereof for threadably engaging the central tube to attach the cover to the base member.

17. A container as defined in claim 16 wherein the base member has corner recesses aligned with the hoop frame to provide access to corner portions of the hoop frame for use of said corner portions as hook members for container support, lifting, and inter-container attachment purposes.

18. A container as defined in claim 17 wherein the hoop frame is located toward an upper end of the base member and is replicated toward a lower end of the base member.

19. A container as defined in claim 18 wherein the lower end of the base member has a throughway providing access for a lifting tine.

20. A container as defined in claim 18 in combination with a hand cart for transporting the container, the hand cart having a tine for receipt in said throughway and elevated transversely spaced hooks for engaging adjacent corner portions of the upper hoop frame.

21. A container as defined in claim 16 including a latch bracket for each compartment supported on the central tube, each latch bracket providing a mounting surface on a peripheral wall of the respective compartment for a latch element of a projectile latching device so that forces developed in the latching element are transmitted through the latch bracket to the central tube.

22. A container as defined in claim 21 wherein the compartments are four (4) in number symmetrically disposed about the central tube and latch rod respectively, the latch brackets being formed on crossing members having central openings by which they are mounted on the central tube, the crossing members defining a central pocket for retaining a nut threaded onto the central tube for retaining the central tube and base member in assembled relation, and the crossing members having outer flanges defining the respective mounting surfaces.

23. A container as defined in claim 21 wherein the latch mechanism includes an elongate lever member extending down the peripheral wall of the respective compartment, the lever member having a transverse actuating portion at its lower end for engagement by a projectile when inserted in the compartment to press the lever member downwards in the compartment, the lever member further having a protrusion thereon for pushing the latch element transversely inwardly relative to the compartment when the lever member is pushed down by the projectile so that the latch element is moved to a blocking position in relation to a rotation band of the projectile, the latch element and lever member having respective latch formations mutually interengaged when the lever is pressed down to a bottom wall of the compartment, and the lever member further having a manual gripping portion protruding from the compartment for releasing the latch formations and allowing the lever to be raised to move the latch element to a non-blocking position whereby the projectile can be removed from the compartment.

24. A container as defined in claim 17 in combination with a plurality of attachment clips for connecting the container to a like container via the corner portions of their respective hoop frames, each clip comprising a loop of resilient material having opposite ends defining a pin-released, barb-type catch.

25. A container as defined in claim 17 in combination with a pair of lifting hooks for attaching the container to a like container via the respective container hoop frames, each lifting hook comprising a U-shaped member with hooked ends and a pivoted safety catch associated with each end of the hook.

26. A self-latching mechanism for an open-topped projectile compartment in a projectile container and the like, the compartment having a generally cylindrical peripheral wall and a base wall, the self-latching mechanism comprising an elongated lever member extending down said peripheral wall with a portion of the lever member being received in a recess in an upper portion of the peripheral wall, and a latch member having an upper portion attached to the peripheral wall across the recess, the latch member extending downwardly from the upper portion over the lever member, the lever member having a lower portion extending transversely across the compartment for engagement by a projectile when inserted in the compartment to push the lever down, a protrusion on the lever member for moving out of the recess and pressing the latch member inwardly to blocking position with respect to a rotation band of the projectile responsive to downward movement of the lever member, the lever member and latch member having complementary latch formations for mutual latching interengagement when the lower portion of the lever member is pressed adjacent the bottom wall of the compartment to retain the latch member in the blocking position, and the lever member further having a manual gripping portion extending upwardly out of the compartment for disengaging the latch formations and lifting the lever member so as to move the latch member to a non-blocking position allowing removal of the projectile from the compartment.

27. A latching mechanism as defined in claim 26 wherein the lever member has a lower end attached to the bottom wall of the compartment, and wherein said lower portion is inclined upwardly from said lower end for engagement by the projectile and flattening against said bottom wall when the projectile is inserted fully into the compartment, said lower portion further providing a spring action urging the lever member upwardly when the projectile is removed from the compartment.

28. A latching mechanism as defined in claim 26 wherein said recess has an inclined ramp portion along which the projection on the lever member moves for moving the latch member between the blocking and nonblocking positions.

29. A latching mechanism as defined in claim 26 wherein the latching formations comprise a latch pin on the latch member and a pin-receiving hole in the lever member.

* * * * *